US006451149B1

(12) United States Patent
McKenney et al.

(10) Patent No.: US 6,451,149 B1
(45) Date of Patent: Sep. 17, 2002

(54) LABEL APPLICATOR

(75) Inventors: Jeff McKenney, Garden Grove, CA (US); Steve Ogren, Yorba Linda, CA (US); Sebastian Gex-Collet, Long Beach, CA (US)

(73) Assignee: Nortek Automation, Inc., Huntington Beach, CA (US)

( * ) Notice: Subject to any disclaimer, the term of this patent is extended or adjusted under 35 U.S.C. 154(b) by 0 days.

(21) Appl. No.: 09/779,265

(22) Filed: Feb. 8, 2001

(51) Int. Cl.[7] ..... B44C 1/165; B65C 1/02; B65C 9/18; B65C 9/36; B65C 9/08

(52) U.S. Cl. ..... 156/238; 156/202; 156/247; 156/277; 156/289; 156/540; 156/541; 156/542; 156/566; 156/580; 156/DIG. 28; 156/DIG. 33; 156/DIG. 37; 156/DIG. 42

(58) Field of Search ..... 156/230, 238, 156/239, 240, 241, 247, 277, 289, 250, 257, 540, 541, 542, 556, 566, 580, 581, 199, 202, DIG. 1, DIG. 5, DIG. 8, DIG. 23, DIG. 28, DIG. 33, DIG. 37, DIG. 42

(56) References Cited

U.S. PATENT DOCUMENTS 4,025,382 A * 5/1977 Del Rosso ..... 156/497
4,124,436 A * 11/1978 Pettis, Jr. et al. ..... 156/542
4,210,484 A * 7/1980 Crankshaw et al. ..... 156/542
4,314,869 A * 2/1982 Crankshaw ..... 156/215
5,167,752 A * 12/1992 Dowling ..... 156/512
5,304,264 A * 4/1994 Wehrmann ..... 156/64
5,865,918 A 2/1999 Franklin et al. ..... 156/64

* cited by examiner

*Primary Examiner*—Jerry A. Lorengo
(74) *Attorney, Agent, or Firm*—James G. O'Neill

(57) ABSTRACT

A label applicator for dispensing and applying labels to articles includes a label leading edge indicating sensor and an adjustable peel bar held at a pickup position. A label support may be used with larger labels that have been partially peeled from a backing strip and remain at the pickup position. Printed labels to be applied to an article have a portion of the surface area of an adhesive side removed from the backing strip before the label is taken by a label pick-up-and-applicating device. A print head may be included in the label applicator between the indicating sensor and the adjustable peel bar. A number of labels may be picked-up simultaneously from the backing strip by a number of pick-up heads to be applied to a number of separate articles.

18 Claims, 2 Drawing Sheets

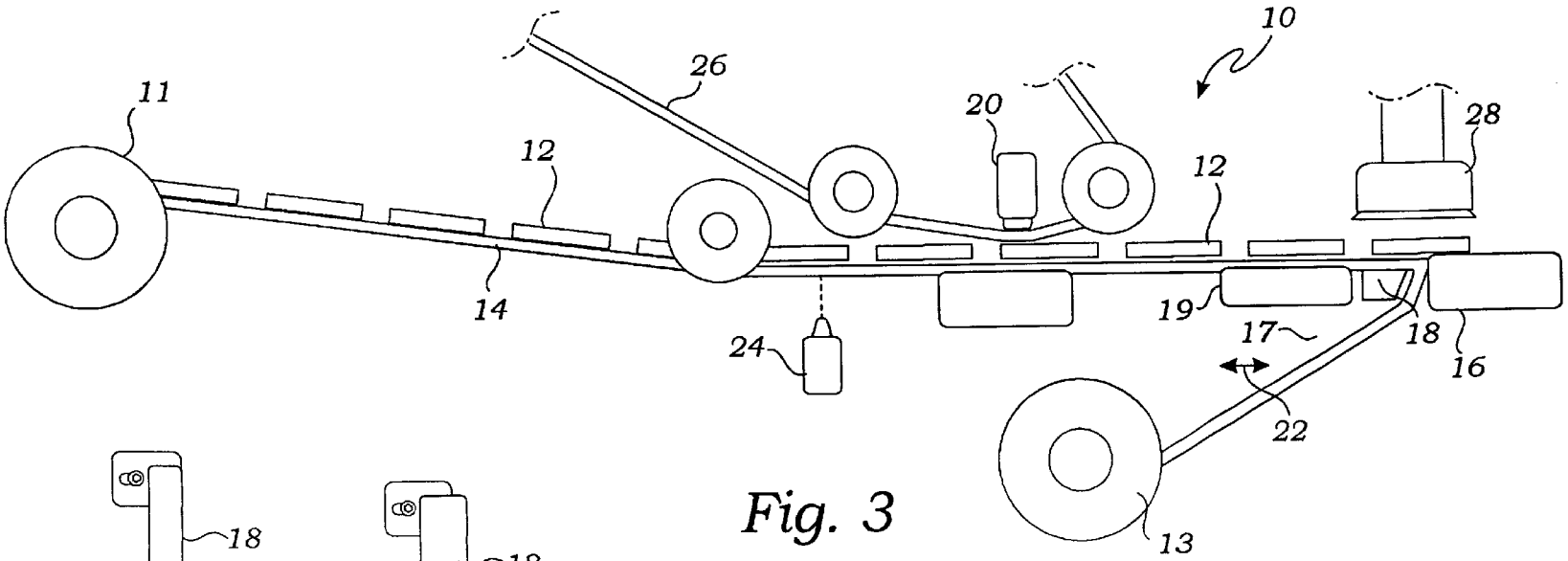
Fig. 3
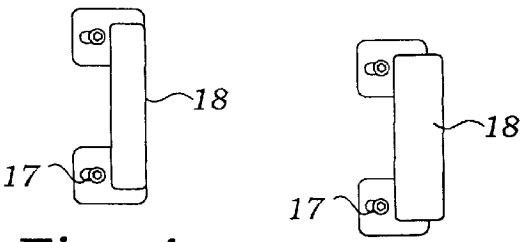
Fig. 4
Fig. 4A
Fig. 4B
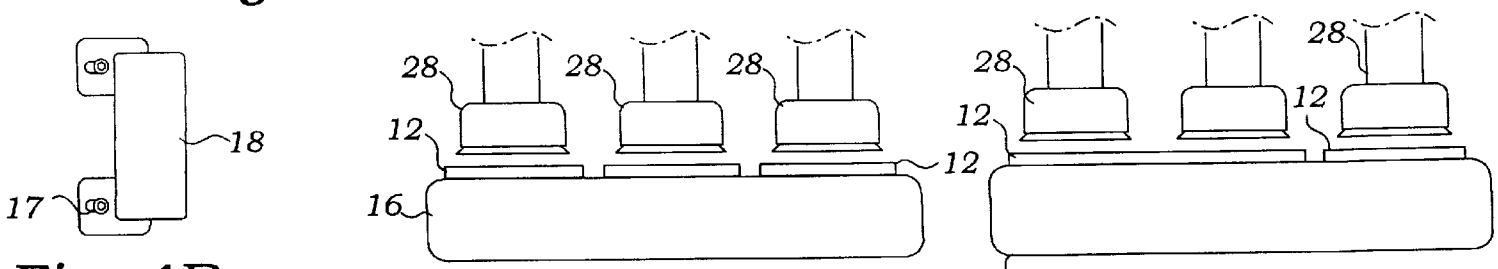
Fig. 5
Fig. 6

LABEL APPLICATOR

BACKGROUND OF THE INVENTION

1. Field of the Invention

This invention relates generally to label applicators, and, more particularly, to an apparatus and method for more accurately applying pressure-sensitive labels to articles.

2. Description of Related Art

As is well known, many articles or products require that some type of adhesive label be applied to the product or packaging therefor, after manufacturing. To meet the different requirements of manufacturers and packagers of such products, many types of apparatus and systems have been proposed and are used. Known types of label applicators include, but are not limited to, air-jet (blow on), synchronous (wipe-on), tamp, corner wrap (similar to wipe-on), flag (wiring cable) and round product applicators.

Many of the known prior art systems use air-assist methods for capturing the label onto a tamp head and applying the label to an article. However, there is a period of time during which the label is "free flying" in space as it releases from a backing and is drawn by a vacuum onto the tamp head. During this "free flying" time, the label may easily by moved out of registration.

Other prior art systems use an intermediate device having a non-stick surface that takes the label from the backing surface and moves the label to a tamp head for eventual application to an article. This transfer of the label from the backing strip to the tamp head by the intermediate device also causes registration problems.

A typical label applicator applies one or more labels to an article as the article is conveyed past the label applicator. For example, a label applicator may include a label dispenser, which dispenses a label onto a label receiver or applicator section. The applicator section then transfers the label to the article.

This transfer is often accomplished by a blast of gas, typically air, under applicator section. The applicator section then transfers the label to the article.

This transfer is often accomplished by a blast of gas, typically air, under pressure. Labels used in these label applicators are usually secured to a backing strip by an adhesive, and the backing strip is wound onto a supply reel, fan-folded, or held in some other manner. The backing strip and labels are moved from the supply reel, or other holding area, through a printing area, if included, by a take-up mechanism, such as a reel, and the labels are peeled off of the backing strip by a peel bar, and momentarily retained at an applicator or label receiver. The applicator or label receiver then transfers the label to a passing article.

However, in all of the prior art systems, there is a measurable gap between the peel bar and the applicator, such as a tamp or transfer head, and the printed adhesive-backed label is removed completely from the backing strip, thereby losing the accurate positioning inherent in die cut labels on backing strips.

The apparatus and method of the present invention utilizes the accurate positioning of die cut printed labels on a backing strip by ensuring that a trailing portion of the printed label remains attached to the backing strip at a pickup point. The label remains in its die cut position on the backing strip until a vacuum head removes the label and applies it to a product. Therefore, accurate positioning of the printed label is always maintained, thereby overcoming the known problems with the prior art.

SUMMARY OF THE INVENTION

In many industries, such as electronics, smaller and smaller labels are required since surface area on many articles or products is not available or limited. Furthermore, high-resolution printers used to print on the labels to be applied to the products are able to print more condensed bar codes, two-dimensional codes, graphics, and/or wording on such labels. Therefore, accuracy of print location on the label and accuracy of the label placement on the article to be marked are imperative for automatic identification by bar codes, two-dimensional codes, optical character recognition and other vision systems used to keep track of such articles.

The present invention enables increased accuracy, increased throughput by the ability to simultaneously pick up multiple labels, and increased reliability by eliminating intermediate pick up mechanisms. The present invention eliminates the need for back feeding of labels in order to print accurately on all areas of a label, when a print head is used with the system. By eliminating the back feeding, mechanical backlash is eliminated, thereby improving the relative position accuracy of the label, print head and peel bar.

It is, therefore, a general object of the present invention to provide an improved and simplified label applicator. It is a particular object of the present invention to provide an improved and more accurate label applicator. It is another particular object of the present invention to provide an improved label applicator, which may be used with pre-printed labels or in print-and-apply systems. It is yet still another particular object of the present invention to provide an improved print-and-apply system having a specifically added peel bar assembly, which peel bar assembly is adjustable and provides the capability for mechanically adjusting the critical distance between a print head and the peel bar, depending on the size of labels to be printed. It is yet a further particular object of the present invention to provide an apparatus and method for ensuring that at least the trailing edge of labels remain attached to a backing strip, and that the labels remain in their die cut position on a backing strip until a vacuum head removes the labels and secures the labels to articles whereby accurate positioning of the label on the articles is always maintained. And, it is a further particular object of the present invention to provide an improved label applicator in which there is no free flying label, intermediate mechanism to transfer labels to a pick up head, or a gap between a peel bar and a tamp head specifically designed to allow the label to be completely peeled from the backing strip for attachment to the pick up head.

These and other objects and advantages of the present invention are achieved by providing an improved label applicator for applying labels to articles.

The label applicator allows at least the trailing edge of labels to remain attached to a backing strip after the leading edge passes over a peel bar. The labels remain in their die cut position on the backing strip until a vacuum head removes the labels from the backing strip and secures them to articles. The improved method and system of the present invention includes an adjustable peel bar cooperating with sensing means that ensure that a leading edge of each label is properly aligned before dispensing or printing, to thereby always provide proper alignment of the labels during printing and dispensing of labels onto articles.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein like reference numerals are used throughout the several views, and, in which:

FIG. 3 is a further diagrammatic view of the system of the present invention showing the adjustability of a peel bar when different size labels are being printed and/or dispensed by the system;

FIGS. 4–4B are further diagrammatic views showing various size adjustable peel bar portions for use in the present invention; and FIGS. 5 and 6 are diagrammatic views, showing how a plurality of labels, of different size, may be simultaneously picked up by a plurality of separate tamp heads.

DESCRIPTION OF THE PREFERRED EMBODIMENTS

The following description is provided to enable any person skilled in the art to make and use the invention, and sets forth the best modes contemplated by the inventors for carrying out their invention. Various modifications, however, will remain readily apparent to those skilled in the art, since the generic principles of the present invention have been defined herein specifically to provide for an improved and simplified label applicator 10 for precisely and accurately printing and/or dispensing and applying labels on articles or products.

Figure 1:
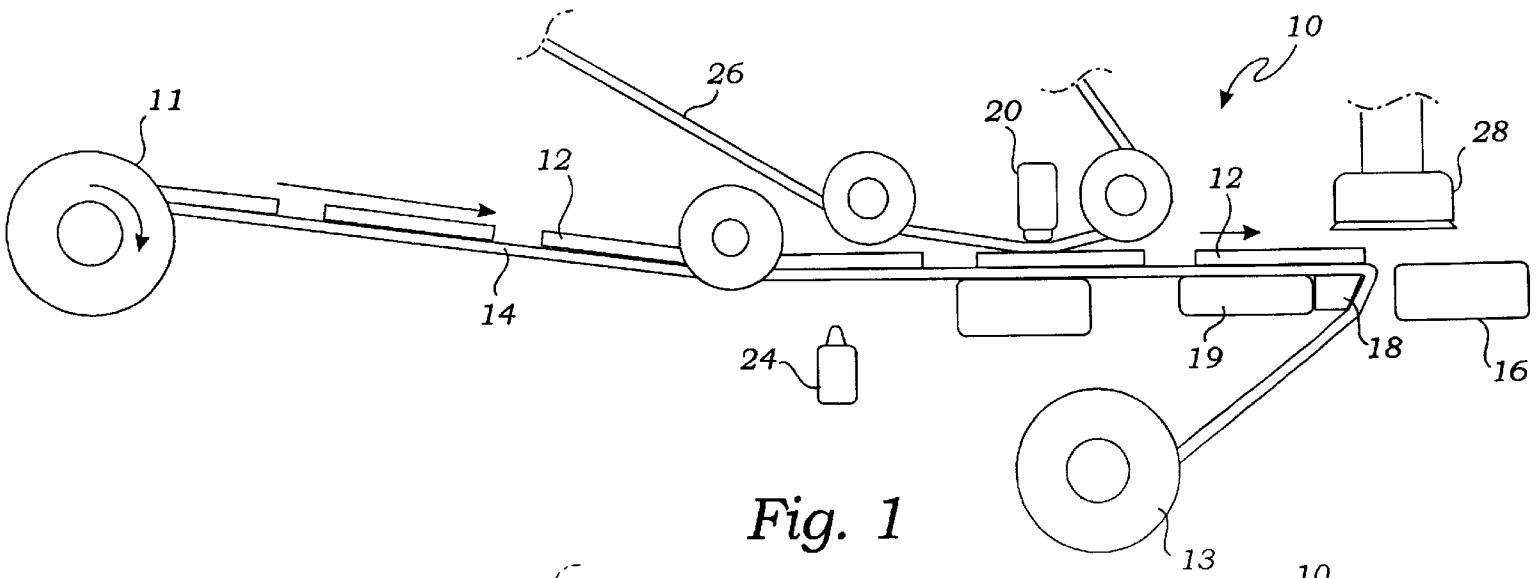
FIG. 1 is a diagrammatic view of an improved label applicator system of the present invention showing one or more labels printed by a print head.
Figure 2:
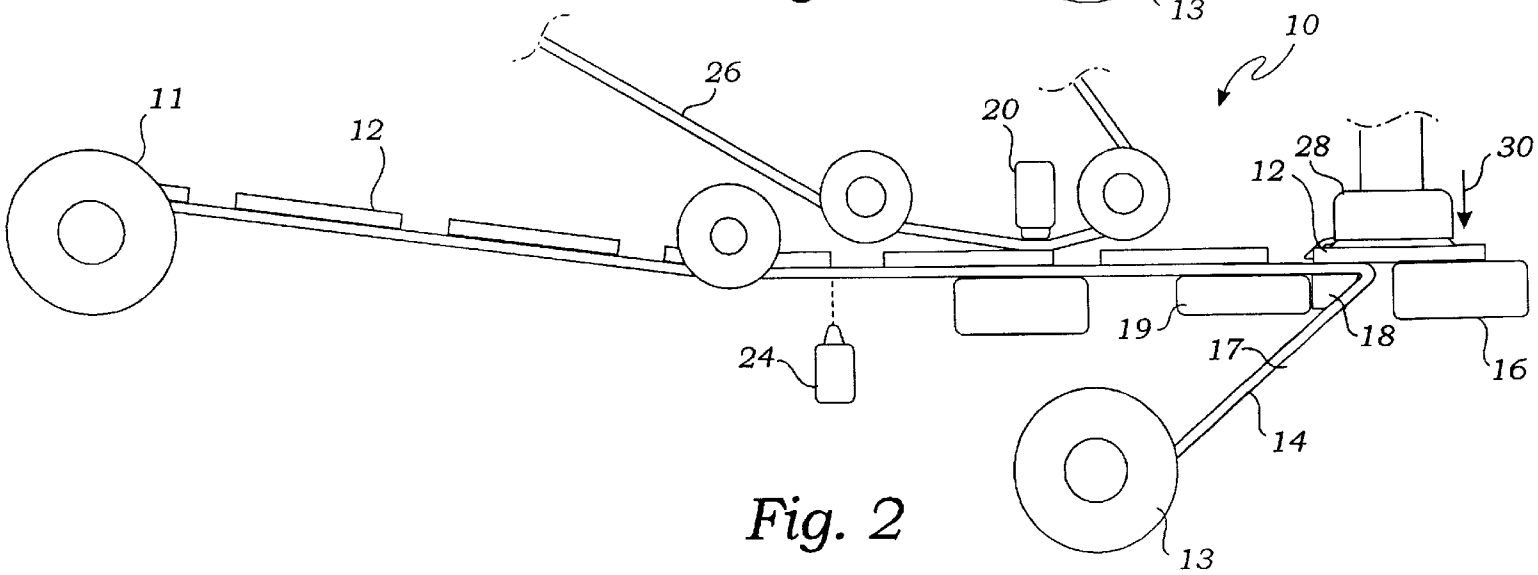
FIG. 2 is a further diagrammatic view of the label applicator system of the present invention showing one or more previously printed labels being picked-up from a backing strip.

Although the applicator 10, shown in the drawings, includes a print head, it is to be understood that the present invention allows very precise and very accurate positioning of one or more preprinted or print-on-demand labels to be maintained by ensuring a percentage of each die cut label 12, remains on a backing strip 14. The percentage varies depending on the label material used, as well as the adhesive adhering the label to the backing strip. As best shown in FIGS. 2 and 4, the percentage of the label remaining on the backing strip 14 is preferably less than 50% of the label surface area and, in most cases, could be between 10% and 20% of the label surface area. If the label 12 being dispensed is large, a further support 16 may be provided for an outer portion of such a label (see FIG. 2).

Precise relative positioning between a peel bar assembly, including parts or portions 17, 18 and 19, and a print head 20, if used, eliminates the need for reversing the direction of the backing strip 14 between the feed reel 11 and take up reel 13, in order to print on all areas of following labels, thus eliminating mechanical backlash. In the present invention the peel bar assembly is adjustable by moving an adjustable outer plate 18 with respect to a fixed inner plate or portion 19 for different label sizes. The adjustable peel bar plate 18 is moved in the direction of arrow 22 by use of adjusting screws 17. The adjustable peel bar 18 is provided in various lengths for increased adjustability in the direction of arrow 22 in order to accommodate additional label sizes. Any known thermal printer, such as an Apollo, Intermec, SATO, Zebra, or the like, having a peel bar 19 thereon may be used. The adjustable peel bar or plate 18 is a specifically designed item that is added to the printer peel bar 19, to move the label pick-up location away from the printer peel bar to avoid interference between the printer and the label pick-up mechanism. The system 10 of the present invention includes a sensor 24 that cooperates with software in known printers to precisely adjust the position of labels as the labels are indexed from positions before printing, during printing and pickup from the backing strip 14.

As best shown in FIGS. 2 and 3, after labels have been accurately printed by the print head 20, pressing against a thermal transfer ribbon 26, or the like, indexed forward and partially peeled from the backing strip 14, one or more pickup heads 28, such as a vacuum head, are moved in the direction of arrow 30 to positively pickup and remove labels 12 from the backing strip 14, and apply them to articles (not shown), by moving the pickup head assembly 28 to articles and separately actuating individual tamp heads to apply the labels. As shown in FIGS. 5 and 6, when a plurality of labels 12 are printed and partially peeled, or preprinted labels 12 are partially peeled from the backing strip 14, depending on the size of the labels, individual pickup heads 28 will cooperate to pick up one or more labels from the backing strip.

As can be seen in FIGS. 1, 2, 5 and 6, since the die cut labels 12 are not completely removed from the backing strip 14, until the pickup heads 28 are moved into contact with each label, after the labels are partially peeled from the backing strip, the labels will remain accurately positioned, both during printing and for pickup by the pickup heads for application of the labels to articles.

The die cut labels 12, taken from the supply reel 11 by the take-up reel 13 after passing over the peel bar assembly 18, 19, remain accurately positioned on the backing strip 14, until mechanically removed from the backing strip 14 by the pickup heads 28. As discussed above, the labels 12 may be preprinted and accurately dispensed, or may be printed using the print head 20 and the thermal ribbon 26, and then accurately dispensed using the method and system of the present invention.

The present invention allows high volume labeling in an accurate and precise manner by taking advantage of the accurate placement of die cut labels on a backing strip whereby preprinted labels remain in position until partially peeled and picked up, and blank labels remain in position during printing and partial peeling until removed from the backing strip by pickup heads and applied to an article.

Those skilled in the art will appreciate that various adaptations and modifications of the just described preferred embodiments can be configured without departing from the scope and spirit of the invention. Therefore, it is to be understood that, within the scope of the appended claims, the invention may be practiced other than as specifically described herein.

What is claimed is:

1. A method of accurately applying printed labels to specific locations on a plurality of articles, comprising the steps of:

providing a plurality of die cut labels on a backing strip, each label having an adhesive face secured to the backing strip;

partially peeling the plurality of die cut labels in sequence from the backing strip by an adjustable peel bar assembly having a fixed inner plate and an adjustable outer plate for different size labels; and picking up the partially peeled labels from the backing strip at a pickup position with a moving label applicator that moves between the pickup position and a label application position, spaced away from the pickup position.

2. The method of claim 1, further including printing printed matter on a top face of the die cut labels opposite the adhesive face before partially peeling the die cut labels in sequence from the backing strip.

3. The method of claim 2 wherein each label has from 80% to 90% of the surface area of the adhesive face peeled from the backing strip.

4. The method of claim 3, further including placing a label support spaced from the adjustable outer plate and the pickup position to partially support partially peeled larger labels.

5. The method of claim 1, further including placing a label support spaced from the adjustable outer plate and the pickup position to partially support partially peeled labels.

6. A label applicator apparatus for applying printed labels having an adhesive backing at a specific location on an article surface to each of a plurality of articles, comprising:

sensing means for sensing a leading edge of successive labels on a backing strip prior to taking the successive labels from the backing strip;

each label having a printed side and an adhesive side;

means cooperating with the sensing means for sequentially positioning one or more labels into a pickup position;

an adjustable peel bar assembly having a fixed inner plate and an adjustable outer plate for guiding different size labels to the pickup position for sequentially partially peeling one or more labels from the backing strip into the pickup position; and label pickup means for removing partially peeled labels from the backing strip at the pickup position and delivering them to an applicator position.

7. The label applicator of claim 6 wherein the adjustable outer plate is only adjustable along a stream of successive printed labels.

8. The label applicator of claim 7 wherein the one or more labels to be applied to articles are peeled from the backing strip for more than 50% of the adhesive backing surface areas at the pickup position.

9. The label applicator of claim 8 wherein the one or more labels are peeled from the backing strip from 80% to 90% of the adhesive backing surface areas at the pickup position.

10. The label applicator of claim 6, further including a label support, spaced from the adjustable outer plate and the pickup position, to partially support larger labels partially peeled from the backing strip.

11. A label applicator for applying printed labels having an adhesive backing at a specific location on an article surface to each of a plurality of articles, comprising:

a sensor for sensing a leading edge of successive labels on a backing strip, prior to printing;

a printer for printing on one side of a stream of successive labels adhesively held on the backing strip; each label having a printed side and an adhesive side adhered to the backing strip;

means for sequentially moving labels through the printer and over an adjustable peel bar assembly having a fixed inner plate and an adjustable outer plate for different size labels;

each label, after passing over the adjustable outer plate, being partially retained on the backing strip at a pickup position by its adhesive side surface area; and a label pickup moveable between the pickup position where it picks up the labels partially retained on the backing strip and an applicator position where it applies the labels to articles surfaces.

12. The label applicator of claim 11, further including a label support, spaced from the adjustable outer plate and the pickup position, to partially support larger partially peeled labels; and wherein the labels are partially retained on the backing strip at the pickup position by less than 50% of their adhesive side surface areas.

13. The label applicator of claim 11 wherein the labels to be applied to articles are peeled from the backing strip between 10% and 20% of the adhesive backing surface areas at the pickup position.

14. The label applicator of claim 11 wherein the adjustable outer plate is adjustable along the stream of successive labels between the printer and the pickup position.

15. The label applicator of claim 14 wherein the adjustable outer plate includes a screw adjustment mechanism.

16. The label applicator of claim 15, further including a label support, spaced from the adjustable outer plate and the pickup position, to partially support larger partially peeled labels; and wherein the labels are partially retained on the backing strip at the pickup position by less than 50% of their adhesive side surface areas.

17. The label applicator of claim 11, further including a plurality of pick-up heads to pick-up a plurality of partially peeled labels and apply the picked-up labels to a plurality of separate articles.

18. The label applicator of claim 11, further including a pickup head having a plurality of tamp heads to individually pick-up a plurality of partially peeled parallel labels at the pickup position and applying the plurality of picked-up labels to a plurality of different positions on a single article or to separate articles.

* * * * *